US006189278B1

(12) United States Patent
Stegmeier

(10) Patent No.: US 6,189,278 B1
(45) Date of Patent: Feb. 20, 2001

(54) METHOD AND PRODUCT FOR PRODUCING CONTRACTION JOINTS IN POURED CONCRETE FACINGS

(76) Inventor: William J. Stegmeier, 1115 W. Harris Rd., Arlington, TX (US) 76017

( * ) Notice: Under 35 U.S.C. 154(b), the term of this patent shall be extended for 0 days.

(21) Appl. No.: 09/305,623

(22) Filed: May 5, 1999

(51) Int. Cl.[7] ..... E04F 15/14

(52) U.S. Cl. ..... 52/396.02; 249/9; 249/188; 264/31; 52/742.14

(58) Field of Search ..... 52/169.7, 396.02, 52/742.14; 249/188, 187.1, 9; 264/31, 35

(56) References Cited

U.S. PATENT DOCUMENTS 1,141,057 * 5/1915 Heltzel .
3,166,816 * 1/1965 Berg .
3,567,171 * 3/1971 Slominski ..... 249/9
3,968,191 * 7/1976 Stegmeier ..... 52/169.7 X
4,048,270 * 9/1977 Stegmeier ..... 52/169.7 X
4,574,017 * 3/1986 Stegmeier ..... 52/169.7 X
5,156,791 * 10/1992 Sano et al. ..... 264/35 X

* cited by examiner

*Primary Examiner*—Beth A. Stephan
*Assistant Examiner*—Brian E. Glessner
(74) *Attorney, Agent, or Firm*—Daniel Rubin

(57) ABSTRACT

Method and product for the forming of contraction joints in the end face of poured concrete structures that includes a blade-like insert of selective profile configuration corresponding to the profile surface of a form board to be utilized for shaping the end face when poured. The insert is attachable to the profile surface of the form board and includes a blade member extending laterally away from the profile surface to produce a contraction joint in the end face when cured.

12 Claims, 5 Drawing Sheets

METHOD AND PRODUCT FOR PRODUCING CONTRACTION JOINTS IN POURED CONCRETE FACINGS

FIELD OF THE INVENTION

The field of art to which the invention relates comprises forming of a contraction joint in concrete poured facings such as the cantilevered nose cap of a swimming pool.

BACKGROUND OF THE INVENTION

Concrete decking placed around swimming pools is generally on the order of about four inch thickness divided into six foot by six foot bays to prevent adverse, unsightly cracking. This is effected by introducing a wecond plain system comprising placement of a contraction joint which penetrates the concrete when wet through one-third of its thickness. The resulting benefit is that the concrete tends to be weaker in and about the straight lines representing the contraction joint.

It is recognized that concrete when poured begins to hydrate and become chemically hot, so that during the first few hours of setting, the decking is at its most expanded state. As cooling begins, the concrete begins to contract and the wecond plain lines allow for contraction. The shrinkage cracks remain invisible beneath the contraction joint. By also extending the joint around the cantilevered face of the decking, the contraction crack thereat occurs unnoticed behind the nose cap.

Prior to about 1958 when plastic contraction joints were first introduced to the trade, concrete workers utilized a deep jointer displaced across the top of the freshly poured concrete to form the contraction joint. This jointer was attached to a long handle and produced a joint 1 to 1½ inches deep in straight lines across the concrete surface causing a wecond plain that allowed for concrete shrinkage. This method is still widely used throughout the concrete industry on, for example, sidewalks, wall caps, steps and anywhere controlled cracking of concrete is required.

DESCRIPTION OF THE PRIOR ART

Contraction joints for concrete and particularly in vertically oriented facings such as the curved cantilevered nose of a poured concrete pool decking has long been effected by use of either precast nose sections or by the use of a cutting tool after the concrete has set. While functioning well and affording a pleasing appearance, the cost of grooving by hand typically has run about $8.60 per linear foot while utilizing pre-cast units has run about $21.00 per linear foot.

While the foregoing costs have been recognized as somewhat exorbitant, it has not been known heretofore how they can be significantly reduced.

OBJECTS OF THE INVENTION

An object of the invention is to provide novel product and method for effecting a contraction joint on the face of concrete structures.

It is a further object of the invention to effect the previous object with a product and method in which the contraction joint can be formed during the pouring and curing of the concrete.

It is a still further object of the invention to effect the previous objects at a substantially lower cost than has been possible by techniques utilized heretofore.

SUMMARY OF THE INVENTION

This invention relates to the formation of contraction joints in concrete structures. More specifically, the invention relates to forming contraction joints in the face of concrete structures such as in the nose cap of swimming pool decking and at a substantially lower cost compared to the current costs of pre-cast units or hand cutting thereof.

For achieving the foregoing, an available form of a configured form board is selected to shape the face of the concrete when poured and in accordance herewith, is provided with a plurality of longitudinally spaced blade-like inserts removably secured on the interior of the form board. With the form board in place to receive the poured aggregate, the inserts laterally extend forward of the form board into the face-path of the concrete. Being that the blades penetrate the concrete, subsequent removal of the insert along with removal of the form board after the concrete has cured, results in a cast formation of a contraction joint thereat. Yet, with the inserts still in place, a cement finishing person using a straight edge for alignment, can rectilinearly advance a deep joint tool successively from each bladed insert toward the opposite side in order to effect continuity of the contraction joint from on the vertical edge to the adjoining horizontal surface.

Each insert is constructed of a suitable plastic composition such as polyethylene, PVC, etc. and can conveniently be formed by injection molding. It can be formed in a variety of different configurations to fit each and every form board profile. As a result, the cost of forming the contraction joint is typically reduced to less than about ten cents per linear foot, that can be appreciated, is significantly less than the cost of either pre-cast units or hand cutting the concrete face as noted supra.

The end result is that the poured aggregate, such as the wall cap of swimming pool decking forms a pre-cast appearance at a significantly lower cost than the pre-cast units or a hand carving of the prior art and can be utilized on any concrete face with which a form board is utilized. The virtues thereof can be readily appreciated by those skilled in the art.

The above noted features and advantages of the invention as well as other superior aspects thereof will be further appreciated by those skilled in the art upon reading the detailed description which follows in conjunction with the drawings.

DESCRIPTION OF THE PREFERRED EMBODIMENT

Figure 1:
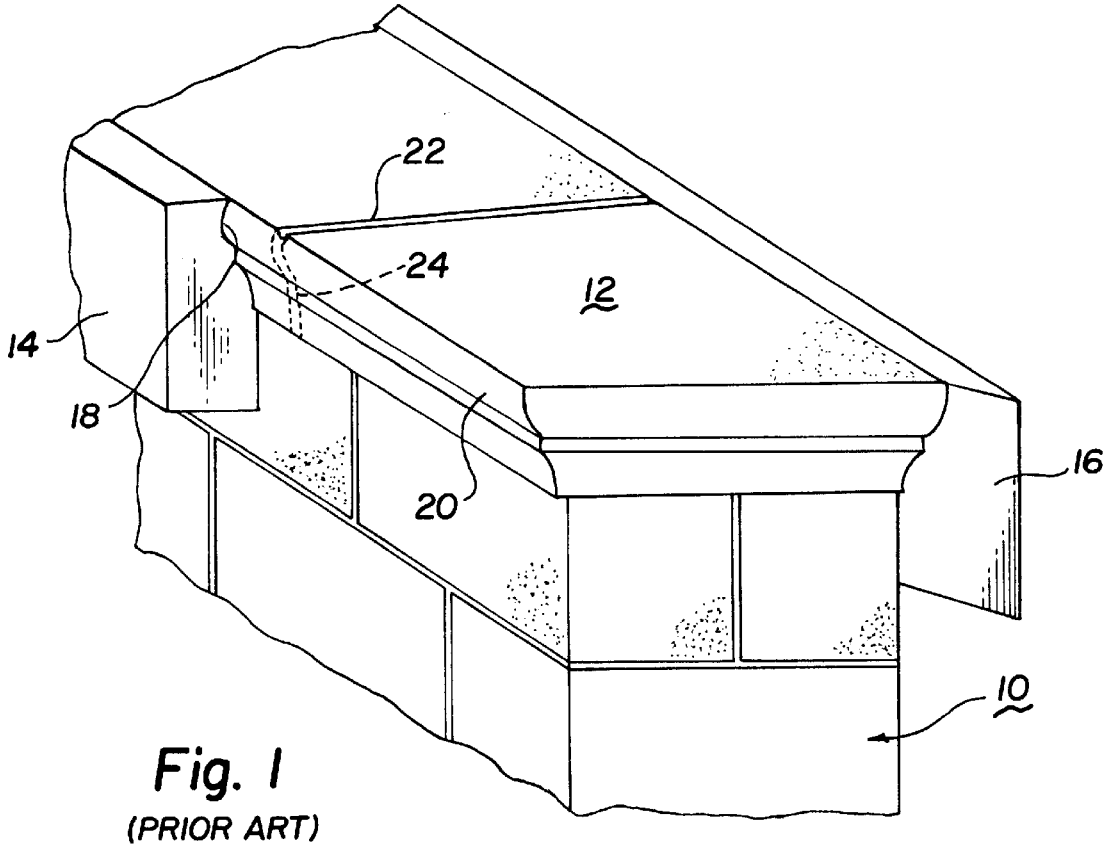
Fig. 1 (PRIOR ART)
FIG. 1 is a prior art isometric view of a poured concrete wall cap in preparation of being formed.

In the description which follows, like parts are marked throughout the specification and drawings with the same reference numerals respectively. The drawing figures are not necessarily to scale and in certain views, proportions may have been exaggerated for purposes of clarity.

Referring now to FIG. 1, there is illustrated a prior art construction of a wall 10 as might be utilized, for example, for patios or the like. Included is a poured concrete wall cap 12 disposed utilizing opposite form boards 14 and 16 of a selected facing profile 18 to form perimeter face 20. Contraction joints 22 have been formed in the horizontal surface of cap 12 using a deep jointer (not shown). Shown in phantom, is a vertical contraction joint 24 to be formed subsequently in face 20 after the concrete has cured and the form board 14 removed. Form boards 14 and 16 are of a type commercially available and generally are comprised of styrofoam as disclosed, for example, in U.S. Pat. No. 4,967,424. The selected profile surface 18 is available in a variety of different configurations as will be described more fully below.

Figure 2:
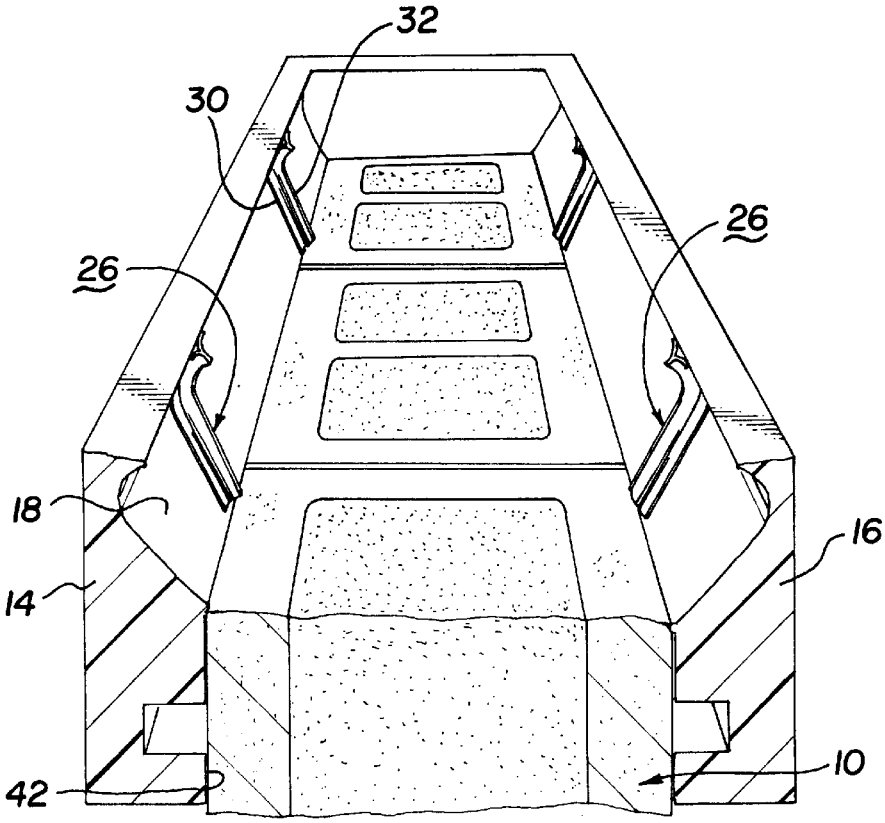
FIG. 2 is an isometric view of the wall of FIG. 1 onto which a wall cap is to be formed in accordance with the invention hereof.
Figure 3:
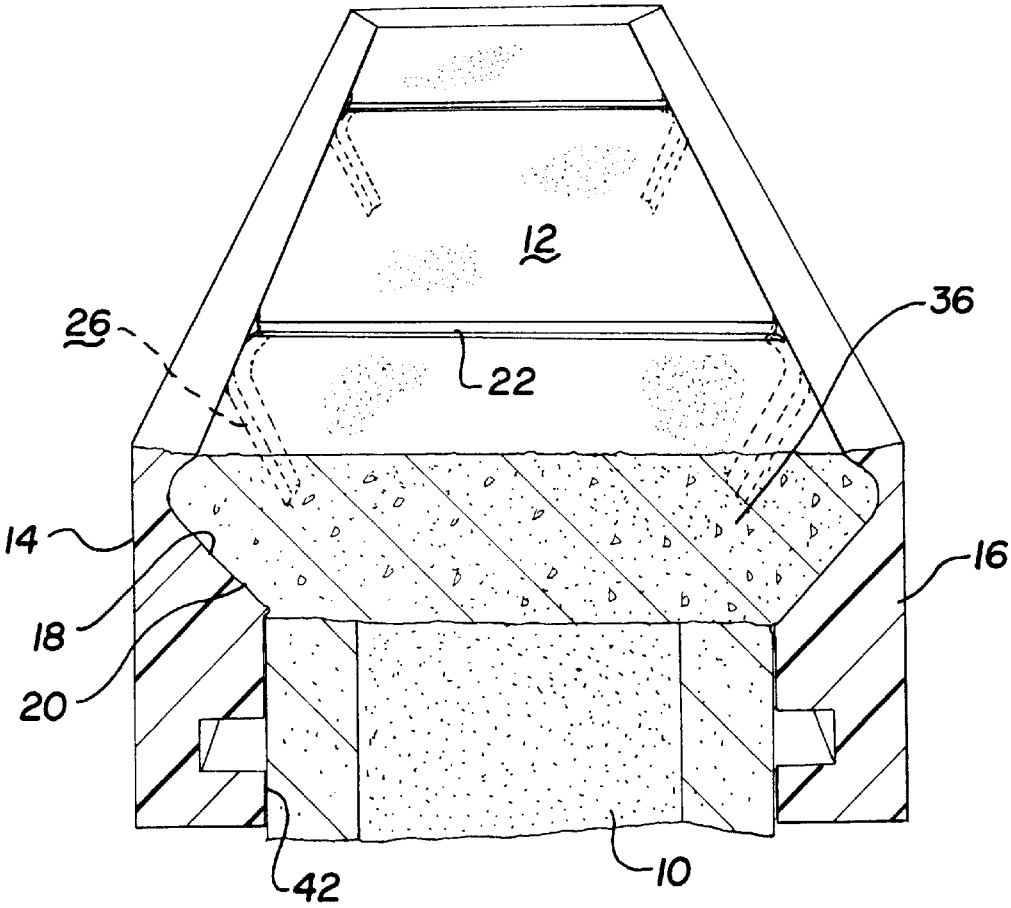
FIG. 3 illustrates the poured wall cap of FIG. 2.
Figure 4:
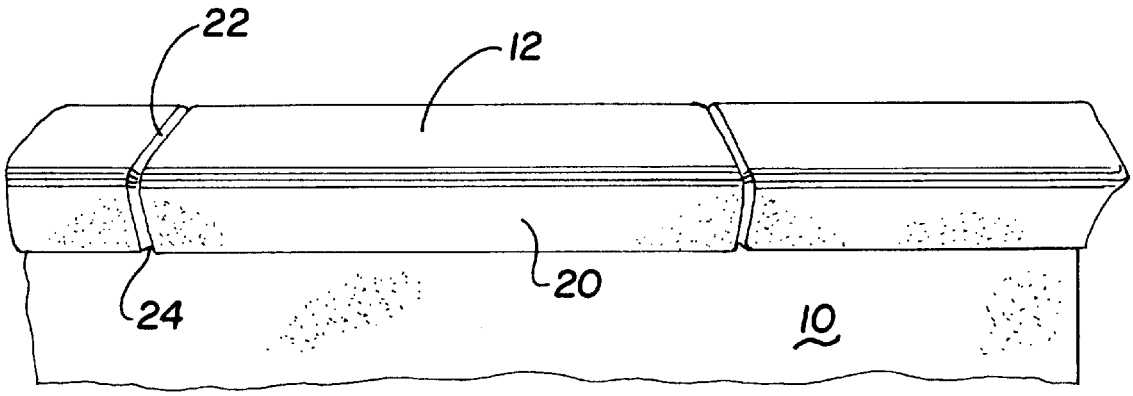
FIG. 4 illustrates the finished wall cap of FIG. 2.

Referring now to FIGS. 2–4, there is illustrated forming the wall cap 12 on wall 10 in accordance with the invention to include contraction joints 24 in face 20 of the finished wall cap. For achieving that result, there is provided a plurality of oppositely placed blade-like inserts 26 attached and conforming to the interior profile surface 18 of each form board 14 and 16 at predetermined longitudinal spacings. The inserts are each formed of a plastic composition such as polyethylene, PVC, etc. that are injection molded to conform with the profile of the form board on which they are to be utilized. Each insert is configured in a T-shaped cross-section having a back wall 30 on the order of up to about one inch in width for engaging and attaching against the profile surface 18 of the form board. Laterally extending integral from the back wall is of a centrally located, integral blade 32 having a pre-determined profile width "x" (FIG. 5) on the order of about ⅝–1 inches and a thickness "Y" (FIG. 7) of about ¼ inch. A radius 48 along each corner of distal edge 50 on the order of about 3/32–1 inch provides draft for removing the blade without disturbing the set aggregate. Each of the inserts are secured to the surface profile 18 of the form board by the use of integral prongs 34 (FIGS. 6 & 8) or other suitable nail-like fasteners known in the art.

With the form boards in place at the pour site and after pouring the aggregate 36 to form wall cap 12 as best seen in FIG. 3, the concrete is permitted to cure after which the form boards 14 and 16 along with inserts 26 are removed. This results in the finished wall cap 12, as best seen in FIG. 4, that includes the contraction joints 24 pre-cast at predetermined intervals into the cap aggregate at the location of removed inserts 26.

Figure 5:
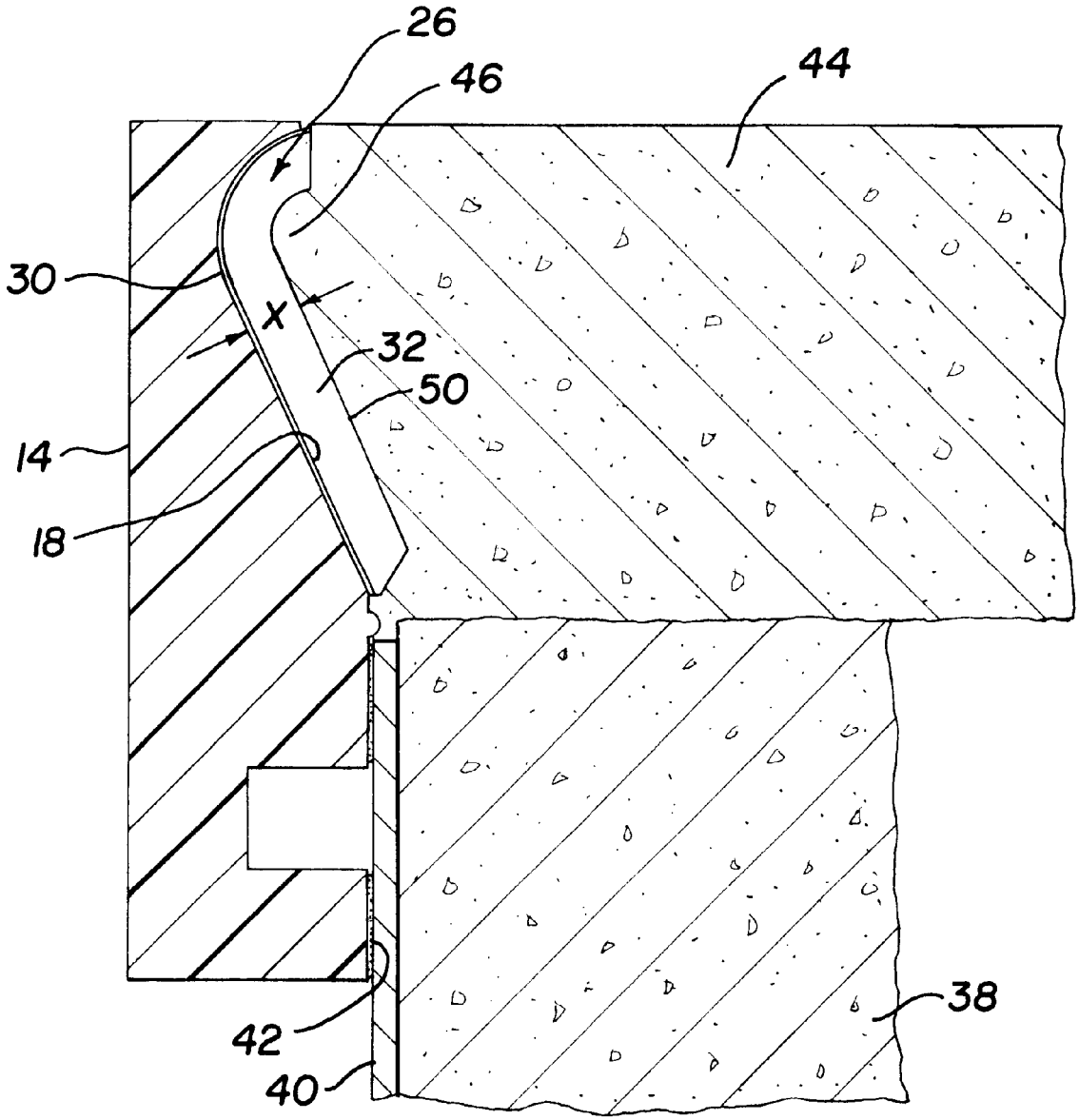
FIG. 5 is a sectional elevation for forming contraction joints in the nose end of swimming pool decking in accordance herewith.

As shown in FIG. 5, a poured concrete wall 38 is illustrated for an in-ground swimming pool on which face tile 40 has been applied in a well known manner. Form board 14 is secured to the face tile via double-faced adhesive tape 42 and defines a surface profile 18 for nose 46 and to which a plurality of blade-inserts 26 are attached. After pouring and curing of the cantilevered decking 44, form board 14 with inserts 26 are removed forming the nose 46 to include surface profile 18 along with the longitudinally spaced contraction joints 24 as before.

Figure 6:
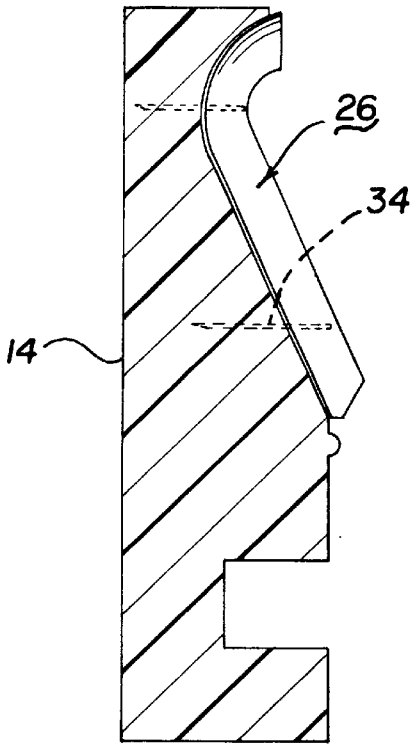
FIG. 6 illustrates a first profile form board supporting a first profile blade-insert in accordance herewith.
Figure 7:
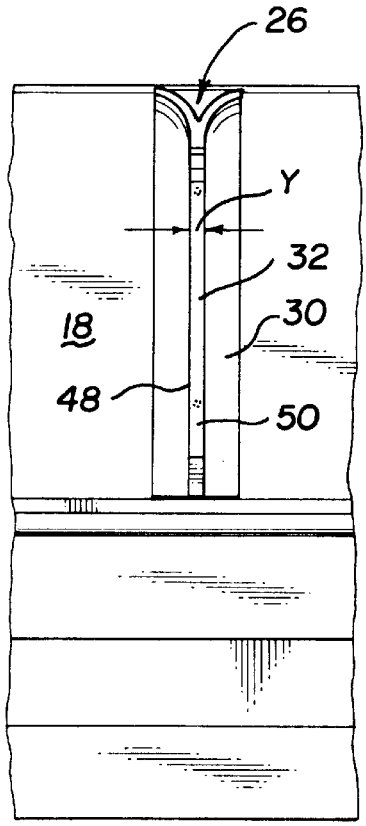
FIG. 7 is a front elevation of FIG. 6.
Figure 8:
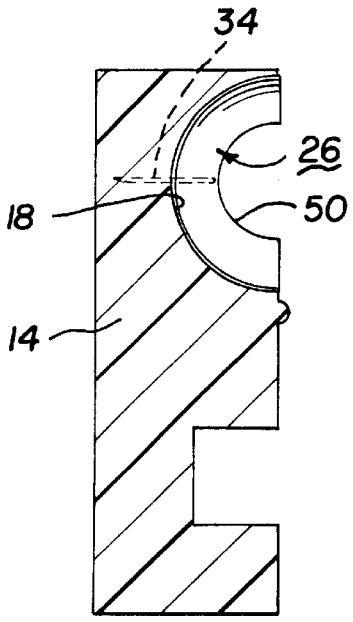
FIG. 8 illustrates a second profile form board supporting a second profile blade-insert in accordance herewith.
Figure 9:
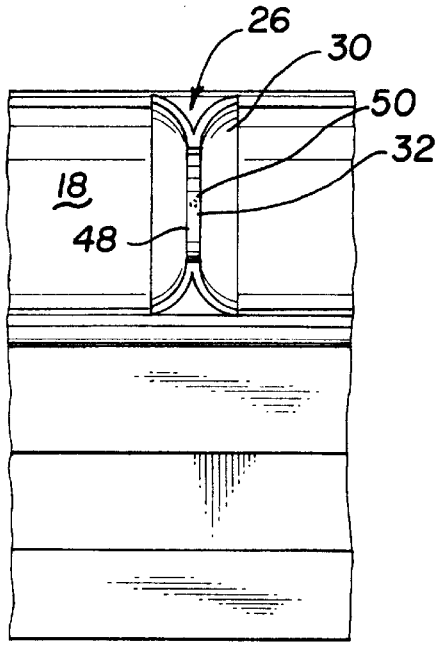
FIG. 9 is a front elevation of FIG. 8.
Figure 10:
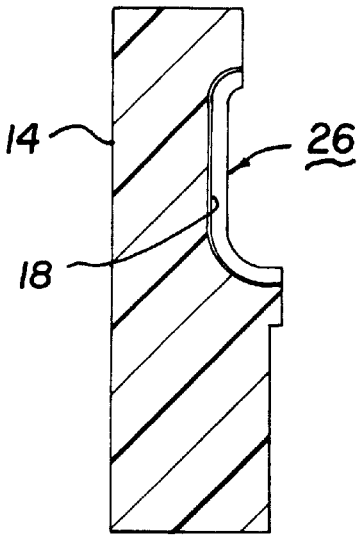
FIGS. 10–12 illustrate various other form board profiles supporting blade-inserts of corresponding profiles in accordance herewith.
Figure 11:
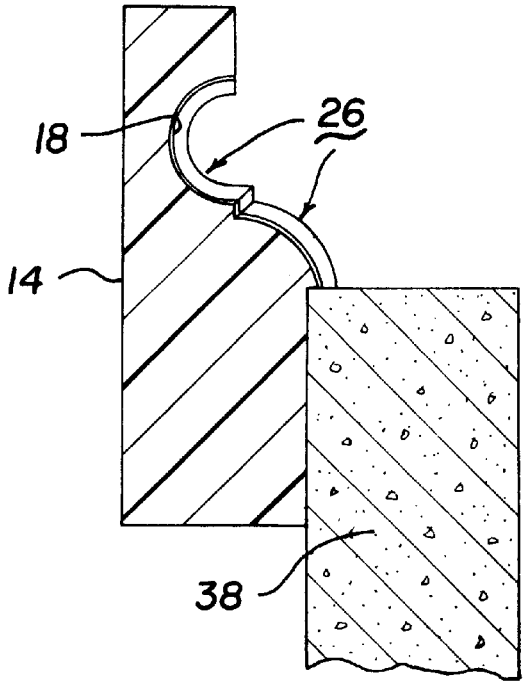
Figure 12:
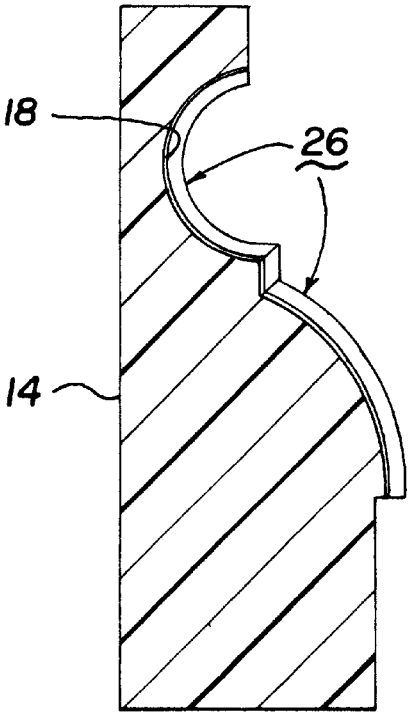

As shown in FIGS. 6–12, blade-insert 26 can be utilized on a variety of form boards 14 having selectively different surface profiles of matching configurations 18. The form board embodiment shown in FIGS. 6 & 7 is commercially marketed as a "Capstone 350"; the form board embodiment of FIGS. 8 & 9 is commercially marketed as a "Mini-Cap 300" while the form boards of FIGS. 10, 11 & 12 are commercially marketed as "Regular 360"; "O-G pattern 400" and "O-G pattern 600" respectively. The form board of FIG. 8 is generally utilized on planter retaining walls while the profile form of FIG. 11 is normally used on patio walls, window ledges and top fascia of Spanish-type buildings. The form profile configuration of FIG. 12 is normally used to cap columns that rise above a block wall at twenty foot intervals and also to cap Spanish-type parapet walls.

The various profile configurations above exemplify the numerous form board profiles with which the inserts 26 hereof may be utilized. Each insert includes a laterally outward extending blade 32 for forming contraction joints in the poured facing of various concrete structures. Obviously, other shapes and configurations can be readily adapted similarly.

By the above description there is disclosed novel product and method for effecting contraction joints in the poured facing of concrete structures. Being relatively inexpensive to provide and utilize, the method and product hereof afford distinct advantages over the formation of such contraction joints in the manner of the prior art without any sacrifice in aesthetic appearance. By means hereof there is afforded a simple yet inexpensive method and product for effecting contraction joints in the end-face of poured concrete structures.

Since many changes could be made in the above construction and many apparently widely different embodiments of this invention could be made without departing from the scope thereof, it is intended that all matter contained in the drawings and specification shall be interpreted as illustrative and not in a limiting sense.

What is claimed is:

1. A method of forming contraction joints in an end facing of poured concrete structures that aesthetically simulate the appearance of juxtaposed units of precast concrete, said method comprising the steps of:

a) providing a form board having a surface profile of said end face to be formed;

b) providing at least one substantially T-shaped blade-like insert rearwardly configured to generally correspond to the surface profile of the provided form board and including a laterally extending blade, said blade being solid of substantially uniform lateral depth on the order of between about ⅝–1 inches and of a flat substantially uniform transverse width of about ¼ inch;

c) attaching said insert to the profile surface of the form board for the blade of the insert to extend laterally away therefrom;

d) mounting the form board with said attached insert at a location at which an end-face of poured aggregate is to be formed;

e) pouring aggregate against said mounted form board; and f) after the curing of said aggregate, removing said form board with attached blade-like insert from the end face whereby to expose a contraction joint in the end face at the location of said removed insert that aesthetically simulates the appearance of juxtaposed units of precast concrete.

2. A method in accordance with claim 1 in which the profile surface of said form board and attached surface of said insert are of matching profile configuration.

3. A method in accordance with claim 2 in which said insert affords a lateral depth sufficient to penetrate the cured aggregate a distance correlated to a pre-determined depth of contraction joint to be formed.

4. A method in accordance with claim 3 in which said insert is comprised of a polymer plastic composition injection molded to a pre-selected profile configuration.

5. A method in accordance with claim 4 in which said form board is formed of a styrofoam composition and each of said inserts is attached to said form board by elongated fasteners extending from said insert into said styrofoam.

6. A method in accordance with claim 4 in which said substantially T-shaped blade like insert section defines a rear plate adapted for attachment to said form board and a blade laterally extending centrally from said rear plate.

7. A method in accordance with claim 6 in which the profile surface of said form board is utilized to shape a nose at the distal end of cantilevered decking of a swimming pool.

8. An insert adapted for attachment to the profile surface of a form board for forming a contraction joint in an end-face of concrete to be poured against the form board that aesthetically simulates the appearance of juxtaposed units of precast concrete, said insert comprising:

a backplate of profile adapted to generally correspond to a profile surface of the form board with which the insert is to be utilized; and a blade member secured to a front of said backplate arranged to extend laterally outward and centrally therefrom into the path of concrete to be poured; said blade member being solid of a substantially uniform lateral depth on the order of between about ⅝–1 inches and of a flat substantially uniform transverse width of about ¼ inch.

9. An insert in accordance with claim 8 in which said insert is formed of a polymer plastic composition and said backplate and said blade member are integrally secured to each other.

10. An insert in accordance with claim 9 in which said insert is substantially T-shaped in transverse section.

11. An insert in accordance with claim 10 in which said blade member is selected of a lateral depth sufficient to penetrate the poured aggregate a distance correlated to a pre-determined depth of contraction joint to be formed.

12. An insert in accordance with claim 8 in which the end face of concrete to be poured is for a concrete structure selected from the group consisting of a cantilevered nose cap of swimming pool decking; planter retaining wall, patio wall, window ledge, top fascia, column cap and Spanish-type parapet wall.

* * * * *